US008939387B2

(12) United States Patent
Fontaine

(10) Patent No.: US 8,939,387 B2
(45) Date of Patent: Jan. 27, 2015

(54) SPRAY GUN

(75) Inventor: James R. Fontaine, Marilla, NY (US)

(73) Assignee: Chapin Manufacturing, Inc., Batavia, NY (US)

( * ) Notice: Subject to any disclaimer, the term of this patent is extended or adjusted under 35 U.S.C. 154(b) by 21 days.

(21) Appl. No.: 13/068,073

(22) Filed: May 2, 2011

(65) Prior Publication Data

US 2011/0266371 A1 Nov. 3, 2011

Related U.S. Application Data

(63) Continuation of application No. 61/343,755, filed on May 3, 2010.

(51) Int. Cl.

| | |
|---|---|
| ***F23D 14/60*** | (2006.01) |
| ***F23D 11/46*** | (2006.01) |
| ***B05B 7/02*** | (2006.01) |
| ***B05B 9/01*** | (2006.01) |
| ***B05B 15/06*** | (2006.01) |

(Continued)

(52) U.S. Cl.

CPC ..... *B05B 1/3046* (2013.01); *B05B 9/01* (2013.01); *B05B 15/065* (2013.01); *B05B 12/002* (2013.01)

USPC ..... 239/528; 239/525; 239/526; 239/527; 239/532; 239/585; 137/614.11

(58) Field of Classification Search

CPC ..... B05B 9/01; B05B 12/002; B05B 1/3013; B05B 1/3046; F03B 11/004

USPC ..... 239/526–528, 532, 583, 416.2, 353; 137/271, 614.11, 614.12; 251/293

See application file for complete search history.

(56) References Cited

U.S. PATENT DOCUMENTS

| | | | |
|---|---|---|---|
| 1,446,746 | A | 2/1923 | Hoxie |
| 1,837,861 | A | 12/1931 | Green et al. |

(Continued)

FOREIGN PATENT DOCUMENTS

| | | |
|---|---|---|
| DE | 1 152 857 | 8/1963 |
| EP | 0 109 268 | 5/1984 |

(Continued)

OTHER PUBLICATIONS

Chapin Manufacturing Inc., Spray 'n Go Sprayer, page from www.chapinmfg.com/RCatalog8.asp, printed Sep. 14, 2011.

(Continued)

*Primary Examiner* — Len Tran
*Assistant Examiner* — Alexander Valvis
(74) *Attorney, Agent, or Firm* — Kenneth J. Lukacher Law Group

(57) ABSTRACT

A spray gun, which is convertible for use with and without an extension wand, may use the valve mechanism and nozzle attached adjacent to the handle of the gun. When spraying requires the spray to be released away from the gun handle and for spot applications of the spraying liquid, the spraying nozzle is removed and the extension wand or tube is attached to the gun handle. The valve assembly remains in place and another valve assembly and nozzle is provided at the end of the extension furthest away from the handle. A rod is attached to and extends between the valves so that they both move together from closed to open positions responsive to the trigger of the spray gun. When the valves are closed, there is no spraying liquid in the extension. The valving is dripless both with and without the extension.

7 Claims, 9 Drawing Sheets

(51) Int. Cl.

| | |
|---|---|
| ***B05B 1/30*** | (2006.01) |
| ***E03B 1/00*** | (2006.01) |
| ***F16K 1/20*** | (2006.01) |
| *B05B 12/00* | (2006.01) |

(56) References Cited

U.S. PATENT DOCUMENTS

| | | | | |
|---|---|---|---|---|
| 1,961,481 | A * | 6/1934 | Downs | 239/415 |
| 2,214,035 | A | 9/1940 | Tracy | |
| 2,238,521 | A * | 4/1941 | Gustafson | 239/574 |
| 2,365,752 | A | 12/1944 | Edwards | |
| 3,053,461 | A | 9/1962 | Inglis | |
| 3,072,345 | A * | 1/1963 | Lennon | 239/456 |
| 3,232,540 | A | 2/1966 | Cassanmagnago | |
| 3,351,288 | A | 11/1967 | Perr | |
| 3,385,524 | A * | 5/1968 | Wahlin | 239/394 |
| 3,589,610 | A | 6/1971 | Wahlin et al. | |
| 3,700,174 | A * | 10/1972 | Beck | 239/526 |
| 3,708,123 | A * | 1/1973 | Krueger | 239/415 |
| 3,814,329 | A * | 6/1974 | Clark | 239/426 |
| 3,857,511 | A | 12/1974 | Govindan | |
| 4,005,824 | A * | 2/1977 | Becker et al. | 239/289 |
| 4,083,474 | A * | 4/1978 | Waite et al. | 222/145.7 |
| 4,197,994 | A * | 4/1980 | Liedberg | 239/61 |
| 4,228,958 | A | 10/1980 | Perry | |
| 4,541,568 | A * | 9/1985 | Lichfield | 239/441 |
| 4,834,293 | A * | 5/1989 | Lichfield | 239/447 |
| 5,092,362 | A * | 3/1992 | Yie | 137/596.1 |
| 5,183,322 | A | 2/1993 | Haruch | |
| 5,215,254 | A | 6/1993 | Haruch | |
| 5,249,746 | A | 10/1993 | Kaneko et al. | |
| 5,271,564 | A * | 12/1993 | Smith | 239/532 |
| 5,336,320 | A | 8/1994 | Hogan et al. | |
| 5,370,357 | A | 12/1994 | Jones | |
| 5,553,785 | A | 9/1996 | Haruch | |
| 5,598,974 | A | 2/1997 | Lewis et al. | |
| 5,699,967 | A | 12/1997 | Conatser et al. | |
| 5,707,010 | A | 1/1998 | Manfre et al. | |
| 5,732,885 | A | 3/1998 | Huffman | |
| 5,740,968 | A * | 4/1998 | Mueller | 239/526 |
| 5,791,564 | A * | 8/1998 | Carra | 239/526 |
| 5,868,321 | A | 2/1999 | Haruch | |
| 5,873,528 | A | 2/1999 | Lewis et al. | |
| 5,899,387 | A | 5/1999 | Haruch | |
| 5,931,508 | A | 8/1999 | Spriegel | |
| 6,000,637 | A * | 12/1999 | Duncan | 239/526 |
| 6,015,100 | A * | 1/2000 | Restive | 239/428.5 |
| 6,182,908 | B1 | 2/2001 | Hamilton | |
| 6,182,911 | B1 * | 2/2001 | Hanks et al. | 239/318 |
| 6,244,527 | B1 | 6/2001 | Ferrazza et al. | |
| 6,267,302 | B1 | 7/2001 | Huffman | |
| 6,279,838 | B1 | 8/2001 | Sivells et al. | |
| 6,325,853 | B1 * | 12/2001 | Hogan et al. | 118/300 |
| 6,345,776 | B1 * | 2/2002 | Hurray et al. | 239/413 |
| 6,702,203 | B2 * | 3/2004 | Jou | 239/346 |
| 6,776,360 | B2 | 8/2004 | Haruch et al. | |
| 6,824,074 | B2 | 11/2004 | Komornicki | |
| 6,827,299 | B2 | 12/2004 | Scotchmur et al. | |
| 6,877,681 | B2 * | 4/2005 | Hartle et al. | 239/691 |
| 6,892,963 | B1 * | 5/2005 | Scarpa et al. | 239/424.5 |
| 6,899,288 | B2 | 5/2005 | Filicicchia et al. | |
| 6,905,084 | B2 | 6/2005 | Hammarth et al. | |
| 6,929,198 | B2 * | 8/2005 | Dexter | 239/754 |
| 6,997,405 | B2 | 2/2006 | Haruch | |
| D518,873 | S | 4/2006 | Carpanese | |
| 7,028,925 | B2 * | 4/2006 | Guest et al. | 239/526 |
| 7,036,753 | B2 | 5/2006 | Huffman | |
| 7,083,115 | B2 | 8/2006 | Huffman | |
| 7,090,150 | B2 | 8/2006 | Amaduzzi | |
| 7,216,816 | B2 | 5/2007 | Hammarth et al. | |
| D547,422 | S | 7/2007 | Carpanese | |
| D551,738 | S | 9/2007 | Tanner | |
| 7,311,271 | B2 | 12/2007 | Micheli | |
| D574,927 | S | 8/2008 | Larsen | |
| 7,490,478 | B1 | 2/2009 | Tilton | |
| D592,277 | S | 5/2009 | Yorns | |
| D600,778 | S | 9/2009 | Meyer | |
| 7,641,133 | B2 * | 1/2010 | Wilfert | 239/419.5 |
| 7,661,609 | B2 * | 2/2010 | Dexter et al. | 239/527 |
| D615,157 | S | 5/2010 | Chen | |
| 7,854,398 | B2 * | 12/2010 | Hahn et al. | 239/444 |
| 7,861,950 | B2 * | 1/2011 | Rossner et al. | 239/345 |
| D636,848 | S | 4/2011 | Fontaine | |
| 2002/0195505 | A1 | 12/2002 | Haruch et al. | |
| 2003/0071144 | A1 * | 4/2003 | Naemura | 239/390 |
| 2003/0136862 | A1 | 7/2003 | Filicicchia et al. | |
| 2004/0144872 | A1 | 7/2004 | Scotchmur et al. | |
| 2004/0159720 | A1 | 8/2004 | Komornicki | |
| 2006/0097070 | A1 | 5/2006 | Huffman | |
| 2006/0151634 | A1 * | 7/2006 | Pivovarov | 239/526 |
| 2007/0125878 | A1 * | 6/2007 | Hahn et al. | 239/332 |
| 2007/0158465 | A1 * | 7/2007 | Ingraham | 239/373 |
| 2007/0228190 | A1 | 10/2007 | Tanner | |
| 2008/0217437 | A1 | 9/2008 | Vanden Berghe et al. | |
| 2008/0257988 | A1 * | 10/2008 | Hahn et al. | 239/525 |
| 2009/0121167 | A1 * | 5/2009 | O'Brien | 251/65 |

FOREIGN PATENT DOCUMENTS

| | | |
|---|---|---|
| EP | 0 116 704 | 8/1984 |
| FR | 1 351 077 | 1/1964 |

OTHER PUBLICATIONS

Chapin Manufacturing Inc., Home & Garden Series, 3 pages from www.chapinmfg.com/AceSprayers.asp, printed Sep. 14, 2011.

Chapin Manufacturing, Inc., Chapin Xtreme Industrial Concrete Sprayer, 2 pages from www.chapinmfg.com/ICatalog5.asp, printed Sep. 14, 2011.

Chapin Manufacturing, Inc., ProSeries Backpack Sprayer, 2 pages from www.chapinmfg.com/RCatalog11.asp, printed Sep. 14, 2011.

* cited by examiner

SPRAY GUN

Priority is claimed to U.S. Provisional Patent Application No. 61/343,755, filed May 3, 2010, which is incorporated herein by reference.

DESCRIPTION

The present invention relates to spray guns and particularly a spray gun which is convertible for use with and without a tube providing an extension wand, hereinafter called an extension.

Extensions are desired for use with a spray gun so as to separate the spray gun from the location where the spray is to be released, which is especially desirable when spraying toxic substances. Extensions are also desired where the spray is to be released in close proximity to the location where spraying is to be carried out as is desirable for spot applications of spraying liquid. Heretofore, spray guns, (sometimes called spray heads) have been available either with or without extensions. In some cases, the extension wand is merely attached to the end of the gun and the valving mechanism of the gun is used in order to control the flow of spraying liquid via the extension. Then spraying liquid can drip out of the extension and dripless operation is precluded. A typical spray gun with an extension with a spring biased trigger operating a rod extending to a valve at the outer end or tip of the extension is shown in various patents related to spraying heads and guns. See for example, Lichfield, U.S. Pat. No. 4,541,568, issued Sep. 17, 1985; Wahlin; U.S. Pat. No. 3,589,610, issued Jun. 29, 1971; Tracy, U.S. Pat. No. 2,214,035, issued Sep. 10, 1940; and Green et al., U.S. Pat. No. 1,837,861, issued Dec. 22, 1931. These patents show various spray guns with spring biased triggers which actuate a valve to open and close a valve seat for allowing pressurized spraying liquid to be sprayed via a nozzle, and also provide for dripless operation. It is desirable to utilize a spraying gun substantially without modification and convert it for use with an extension without otherwise effecting the operation of the spray gun while enabling dripless operation with or without the extension. It is also desired that conversion of the spray gun to operation with or without an extension be readily and quickly accomplished by personnel without a high degree of mechanical aptitude.

It is a feature of the present invention to provide an improved spray gun which is convertible for use with and without an extension without the need to modify the internals of the spray gun and to carry out the conversion entirely outside and separate from the spray gun.

Briefly described, the present invention provides a spray gun convertible for use with and without an extension, and a method of converting a spray gun or head for use with an extension when desired. The spray gun (or head) has a handle and an operating trigger which is convertible from use with a first nozzle, attached to the handle of the spray gun, to use with a second nozzle attached to the handle via an extension. The spray gun has a first valve actuatable by the trigger of the spray gun for valving spraying liquid through the first nozzle when it is attached to the handle. A second valve is disposed in the extension at the end thereof away from the handle which end is adjacent the second nozzle. When the extension is attached to the handle, the first nozzle is removed and a rod extends along within the extension and connects the first and second valves for movement together, such that both first and second valves are operable together responsive to the trigger being retracted or extended in the handle. Both valves are thus assembled with a valve seat for dripless operation. Consequently, spraying liquid passes through the first valve when the first valve is opened by the trigger and flows via the extension to the second valve and out of the second valve for spraying via the second nozzle. The liquid is normally absent from the extension and flows only when both valves are actuated. When the valves are closed, they provide for dripless shut-off. The connection between the valves may readily be accomplished by a screw threaded end of the rod which screws into the first valve. The rod itself does not impede with the flow of spraying liquid to the extension to any substantial extent, and essentially all of the pressure of the spraying fluid which may be derived from a pressurized tank attached to the spray gun is present at the second spraying nozzle at the outer end of the extension. The extension may be attached to the nozzle, that is to the orifice disc thereof by a screw clamp nut around a pipe extending from the handle. When the extension is used, the nozzle is removed and a screw clamp nut attaches the near end of the extension to the pipe. The valve mechanism, including the valve and the valve seat is assembled in operating relationship by the clamp nut. Another clamp nut connects the nozzle at the outer or the far end of the extension and assembles the second valve and its valve seat together with the nozzle in operating relationship at the far end of the extension.

The present invention further provides an attachment providing an extension for a spray gun with an outlet with a first valve. Such attachment has a tube or wand having a first end attached to the outlet and a second end with a second valve with a nozzle, and a rod extended within the tube or wand between the first valve and the second valve to enable the first and second valves to open and close simultaneously.

A method is also provided by the present invention for converting a spray gun with a trigger operated first valve for controlling flow of liquid to be sprayed to a nozzle to a second valve operated by the trigger at the end of an extension tube. Such method has the steps of replacing the nozzle with a nozzle at the end of the extension, and connecting the first valve to the second valve via a rod extending through the extension from the first valve to the second valve.

Further features and advantages of the invention will become more apparent from a reading of the following description in connection with the accompanying drawings in which.

Figure 6:
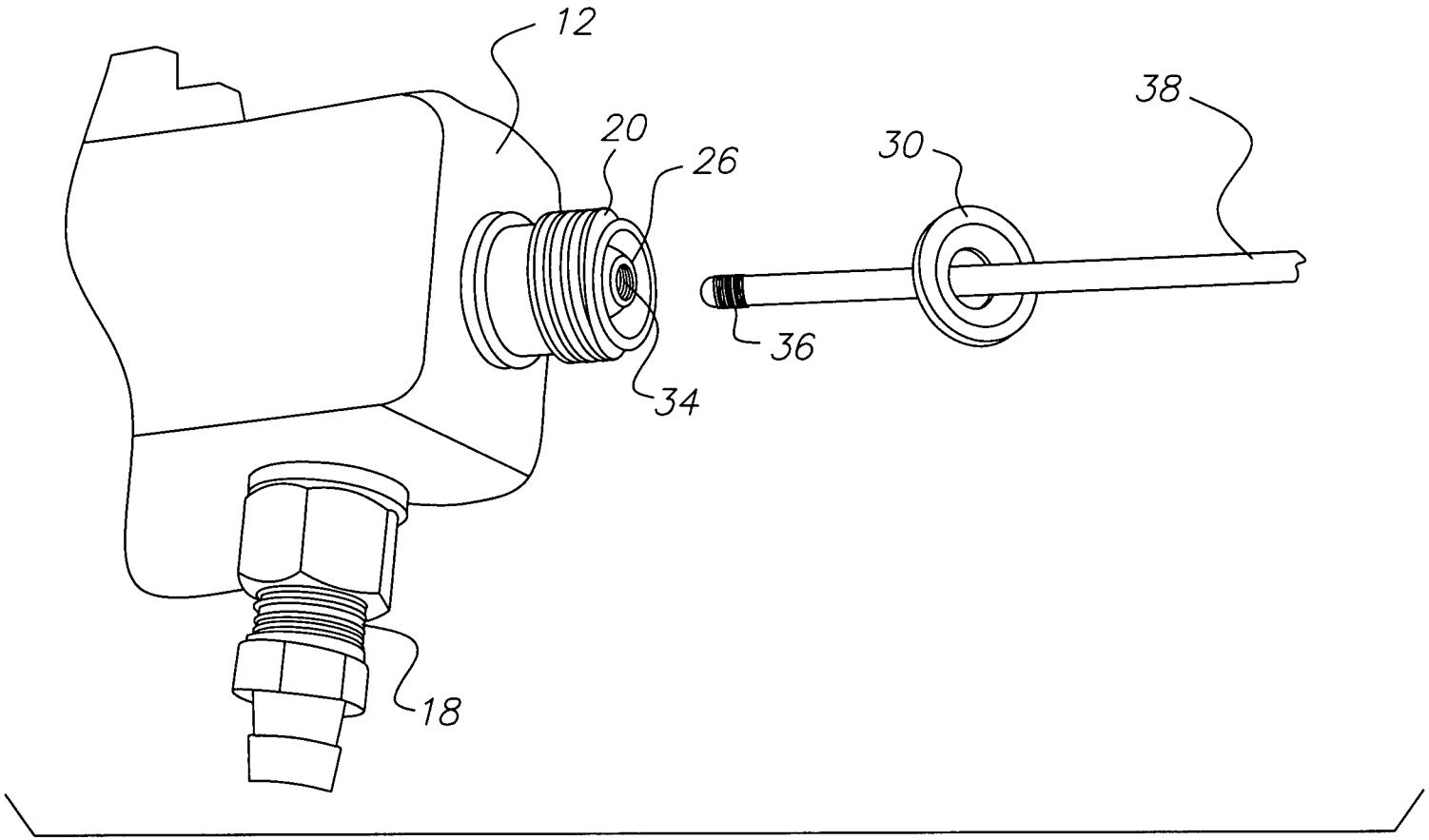
Figure 7:
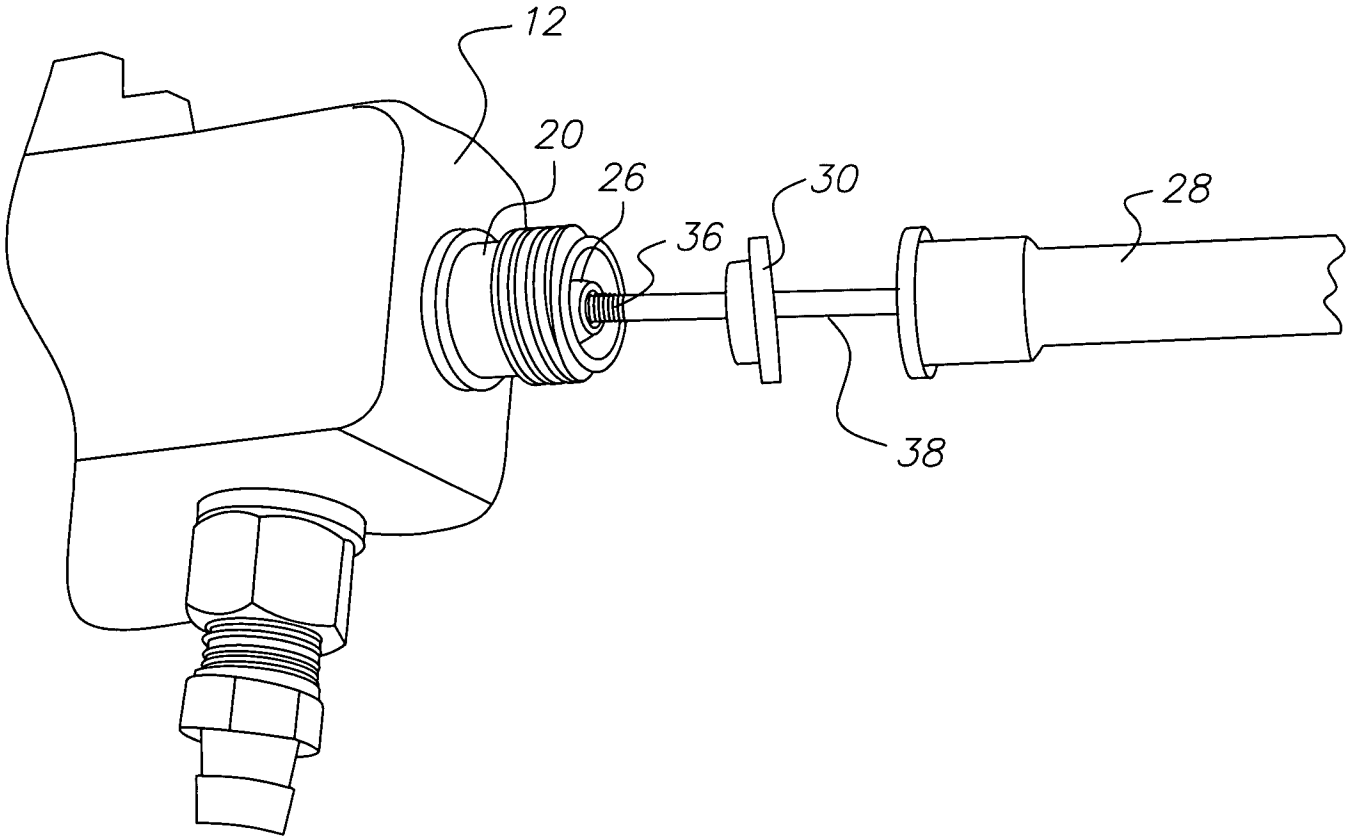

FIG. 6 is an enlarged view illustrating the pipe extending from the spray gun handle and the exposed end of the valve which is threaded to receive a threaded end of the rod, the rod extending through the valve seat before being screwed into place in the threaded hole in the valve; and FIG. 7 is an enlarged view illustrating the assembly of the extension to the spray gun and particularly in the valve located in the pipe extending from the spray gun handle or body.

Figure 1:
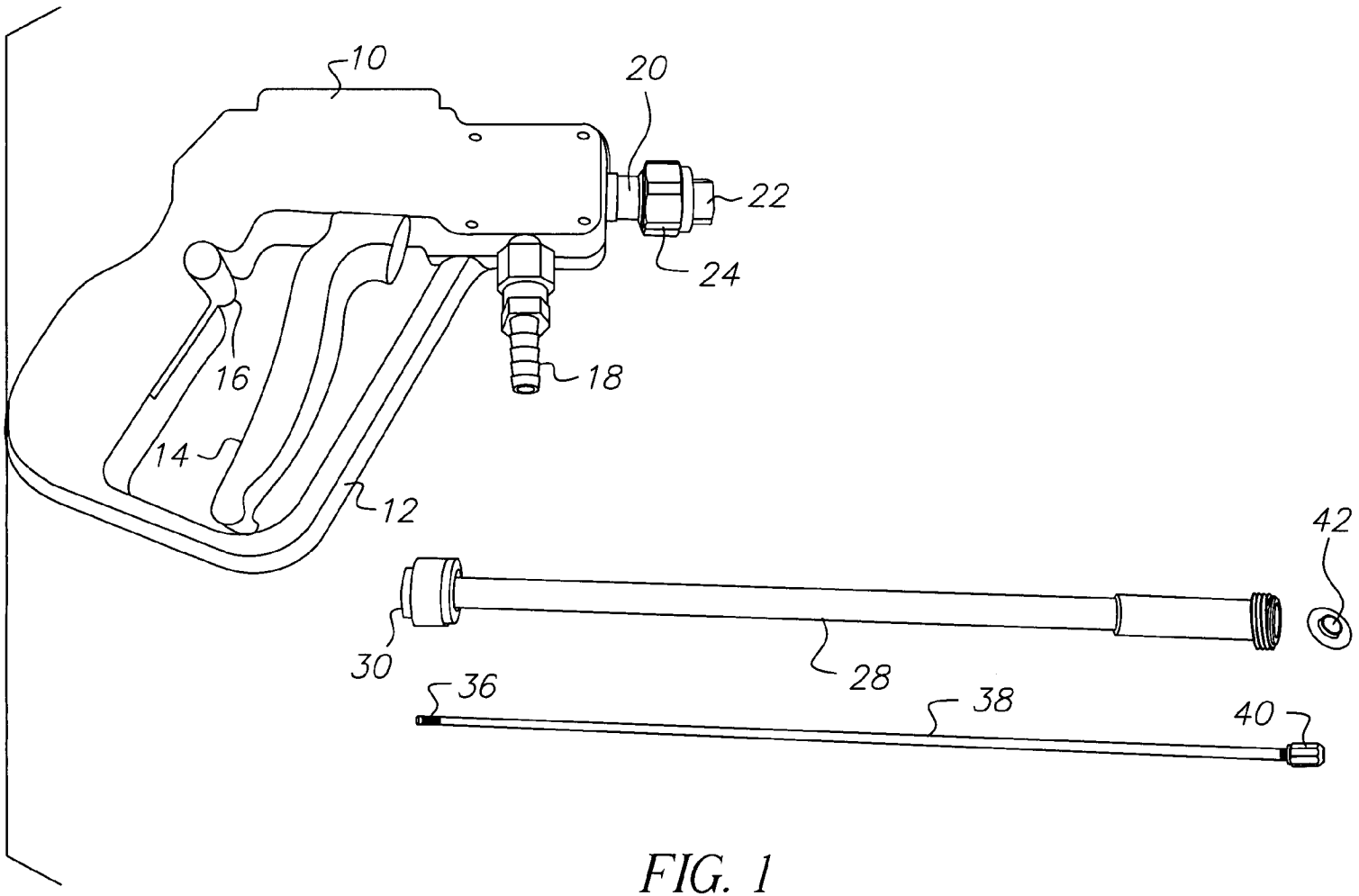
FIG. 1 is a plan view showing a spray gun with a nozzle attached to a pipe extending from the gun and also shows in exploded relationship, parts providing the extension tube and a rod for connecting a valve at the outer end of the extension tube.
Figure 2:
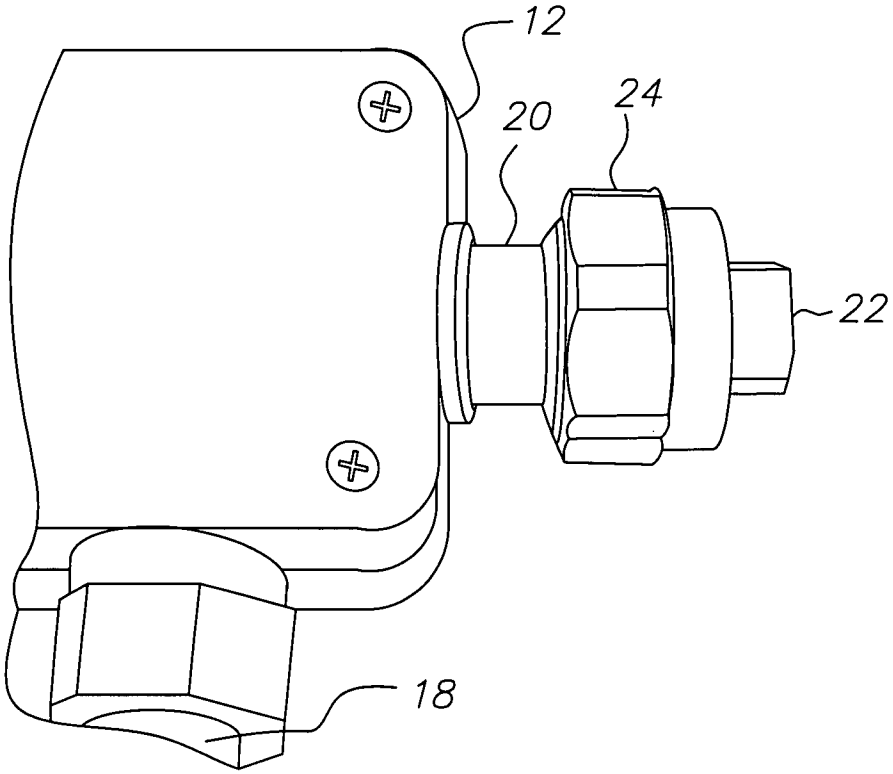
FIG. 2 is an enlarged view of the region of the gun shown in FIG. 1 which has the pipe extending from the gun handle and a nozzle attached to the pipe for use of the gun without an extension.

Referring to the drawings, there is shown in FIG. 1 a spray gun body having a handle 12 with a lever providing a trigger 14. A pivoted stop lever 16 may be used to prevent operation of the trigger 14. The liquid to be sprayed coming from a pressurized tank via a hose is connected to a coupling 18. A pipe 20 which is threaded at the end thereof extends from the handle 12. A spray nozzle 22 is clamped to the pipe 20 by a clamp nut 24. As shown in FIG. 6, a valve 26 is disposed inside the pipe 20 and is attached to be reciprocated by the trigger lever 14 in the same manner as in prior spray guns of the types exemplified in the above-cited U.S. Patents. The valve 26 cooperates with a valve seat 30, which has a sealing portion which protrudes into the pipe 20 and which is assembled around the valve 26 by clamp nut 24 is assembled around the valve by the clamp nut 24. As described so far, the spray gun is adapted to spray with the nozzle and valve assembly disposed adjacent to the handle 12 of the gun. The invention enables the spray gun to be used with an extension 28 which has pipe providing a rigid tube or wand 28*a*. This wand has a flange end 31, and is assembled together with a valve seat 30 by means of a clamp nut 32. The valve 26 has a blind threaded hole 34 (see FIG. 6). This hole 34 receives the threaded end 36 of a coupling rod 38, which extends through the valve seat 30.

Figure 3:
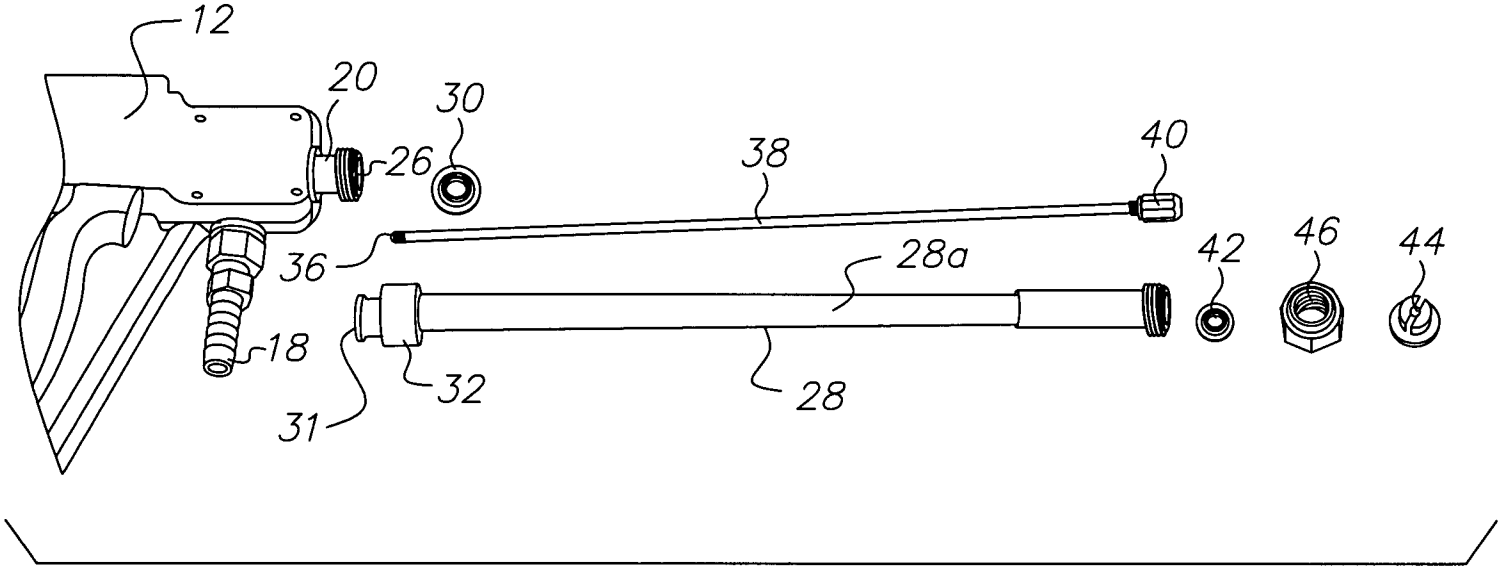
FIG. 3 is a more detailed exploded view showing the gun and parts of the mechanism providing the extension including some of the parts also shown in FIG. 1.
Figure 4:
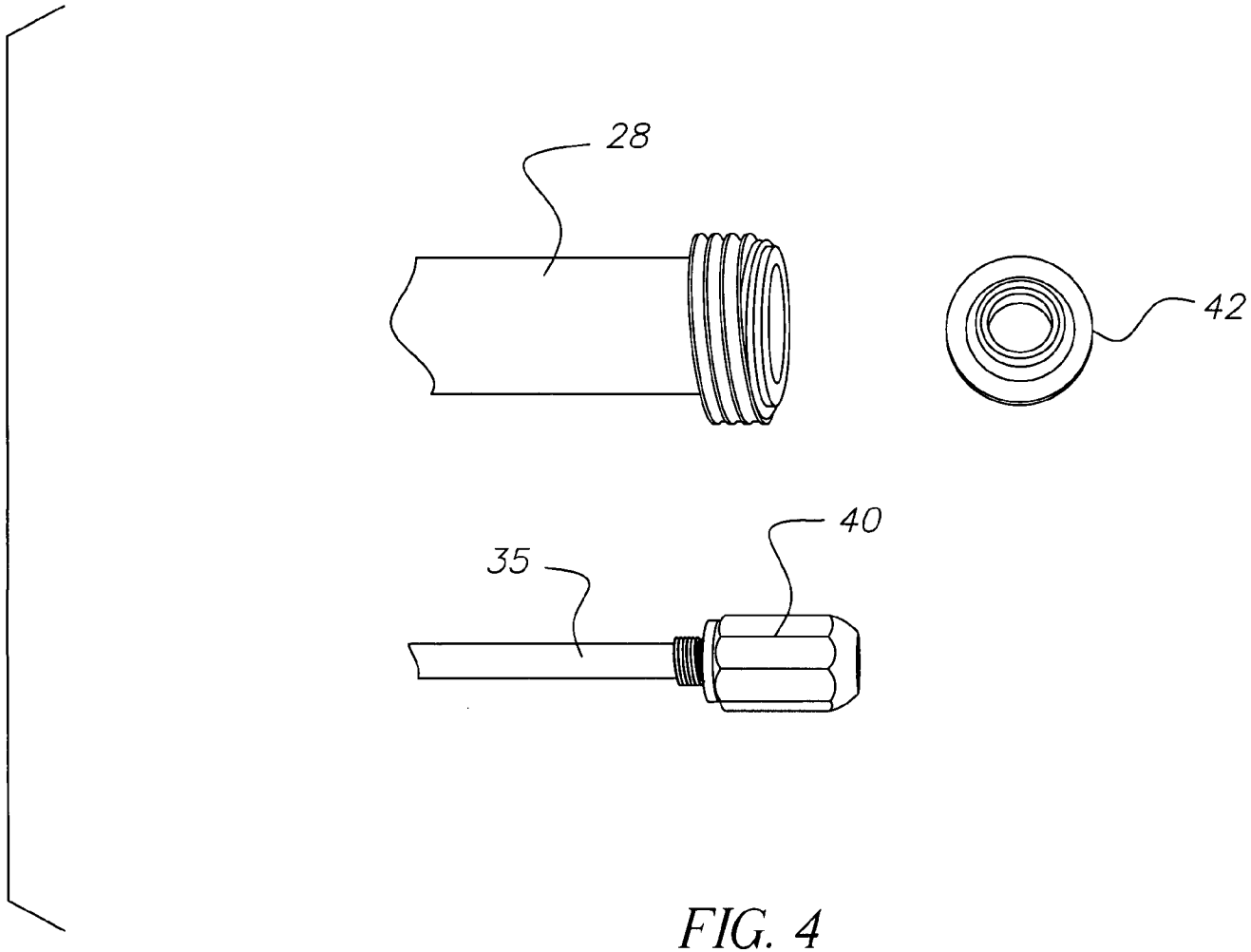
FIG. 4 is an enlarged view showing the end of the extension and the end of the valve which reciprocates within the extension and cooperates with a valve seat.
Figure 4A:
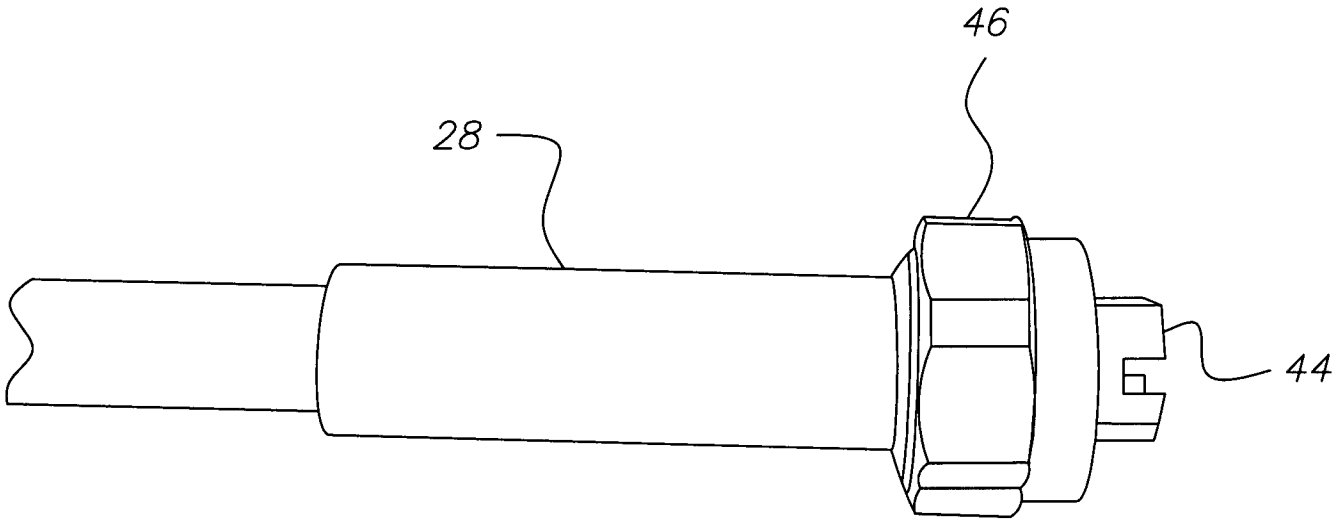
FIG. 4A shows the outer end of the extension with the nozzle assembled thereon.
Figure 5:
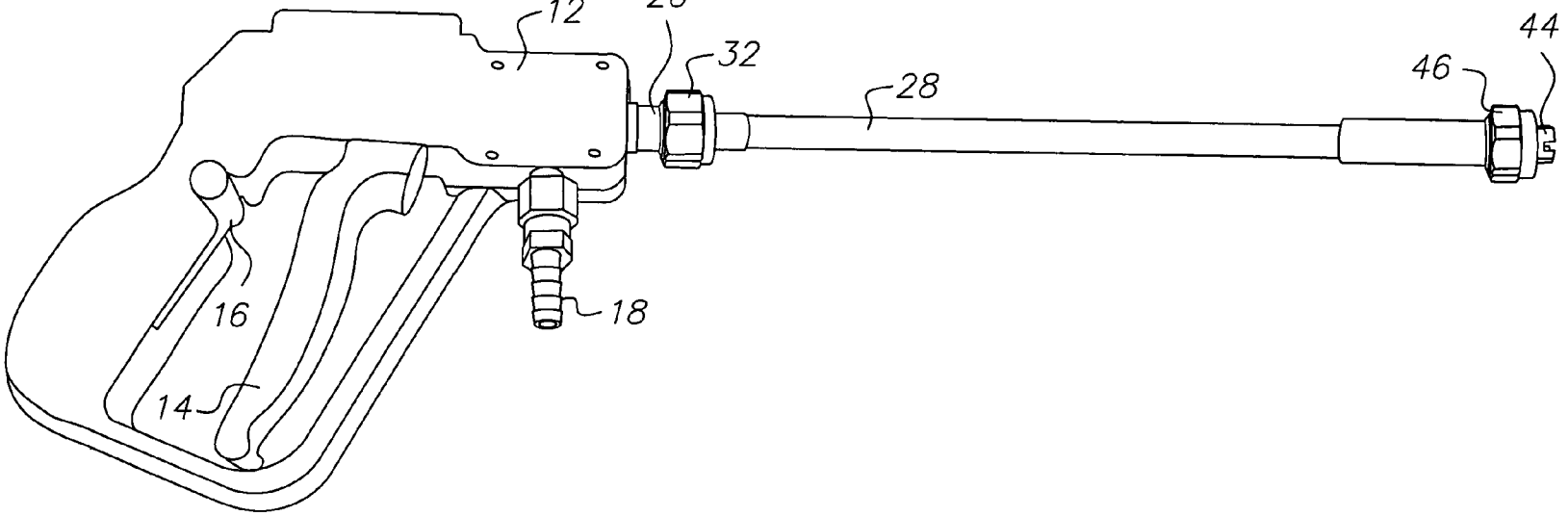
FIG. 5 is a front view of the spray gun with the extension assembled thereon.
Figure 5A:
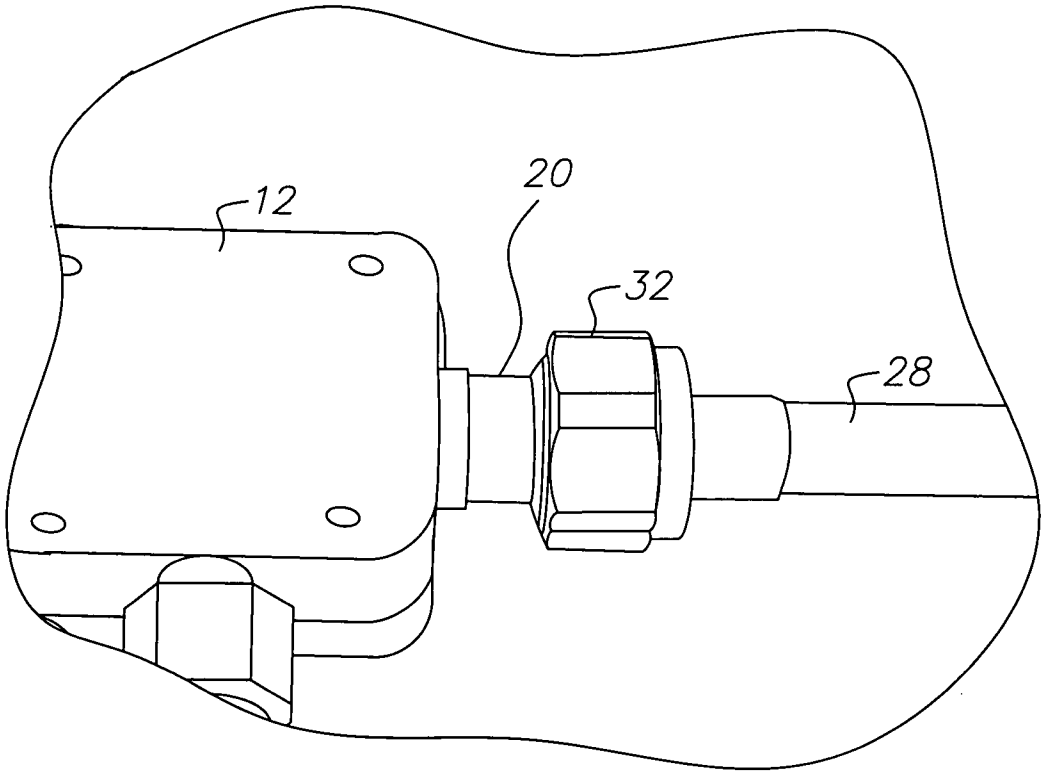
FIG. 5A is an enlarged showing of FIG. 5 in a region adjacent to the handle of the gun.

A second valve 40 which cooperates with a second valve seat 42 is disposed at the end of the rod 38 and within the far end of the extension tube 28, on which the seat 42 is seated which provides a sealing portion which protrudes into the tube 28, and where the seat 42 is assembled together with a nozzle or orifice disc 44 (FIGS. 3 and 4A) by a clamp nut 46 which engages the threaded far end of the extension 28.

It will therefore be apparent that the valves 26 and 40 are coupled together by the rod 38 and opened and closed simultaneously to enable the spraying fluid to be dispensed via their respective valves and out of the spraying nozzle 44 at the far end of the extensions. Dripless operation is thus provided both with and without the extension.

It is a feature of the invention that there is also a dripless shut-off both with and without the extension 28. The valves 26 and 40 with their seats 30 and 42 provide dripless valves. Dripless operation is not provided when an extension is merely attached to a single valve assembly adjacent the handle of a spray gun as in the prior art.

Accordingly, either mode of operation, that is with or without an extension, is provided for in accordance with the invention, providing a convertible spray gun. Moreover, the setup of the extension may readily be accomplished by unskilled personnel. A separate spray gun with and without extensions need not be purchased, thereby making the spraying operation efficient and more cost effective than if two spray gun types were needed.

In summary, to add extension 28 as an attachment to the sprayer gun, the nozzle 22 is removed (pulled out) and nut 24 is removed (unscrewed), and the proximal end of rod 38 is passed through valve seat 30 and threaded into valve 26 as described above, the proximal end of tube 28*a* is then threaded by nut 32 onto the outlet or pipe 20. The valve seat 42 is then positioned onto valve 40 at the distal end of rod 38 and held by nut 46, and the nozzle 44 is positioned into the distal end of tube 28*a*. To detach the extension 28 from the sprayer gun, the opposite to attachment of the extension 28 takes place, valve seat 30 is positioned onto valve 26 and retained by nut 24 onto pipe 20, and nozzle 22 positioned into pipe 20. In this manner, the spray gun is convertible for use with and without an extension without the need to modify the internals of the spray gun and to carry out the conversion readily and quickly entirely outside and separate from the spray gun by personnel without a high degree of mechanical aptitude.

The foregoing and other features and advantages of the invention will become more apparent to those skilled in the art. Accordingly, the foregoing description should be taken as illustrative, and not in a limiting sense.

What is claimed is:

1. A method of converting a spray gun comprising a body, a pipe extending from said body, an operating trigger in which the spray gun has a first nozzle removably attached to the pipe and convertible to use with a second nozzle attached to the pipe via an extension tube, said spray gun comprising the steps of: Providing a first valve disposed in the pipe having a first valve seat part seated on the pipe and a movable valve part actuated by said trigger to seat and unseat said first valve off of said first valve seat for allowing a spraying liquid through said first valve and said first nozzle when said first nozzle is attached to said handle; replacing the first nozzle and connecting a rod to said first valve extending along and inside said extension tube, having said rod connect said first valve to a second valve disposed in said extension tube adjacent said second nozzle, said second valve having a second valve seat part; having the first valve seat with a sealing portion protruding into said pipe, and having the second valve seat being seated on the distal end of said extension tube with a sealing portion protruding into the extension tube; and upon actuation of the trigger, said first valve and said second valve are simultaneously seated and unseated from said first valve seat and said second valve seat so that said spraying liquid passes through said first valve, flows via said extension tube through the second valve for spraying via said second nozzle.

2. The method according to claim 1 wherein the step of connecting the first and second rods comprises the step of providing a screw-in connection to said first valve and said second valve into which opposite ends of said rod are screwed.

3. The method according to claim 2 wherein said screw-in connection is provided by providing threads around said rod at said opposite ends thereof and providing screw threads into openings in said moveable parts of said first and second valves which engage said threads on the opposite ends of said rod.

4. A spray gun comprising a body, a pipe extending from said body, an operating trigger in which the spray gun has a first nozzle removably attached to the pipe and convertible to use with a second nozzle attached to the pipe via an extension tube, said spray gun further comprising:

a first valve disposed in the pipe having a first valve seat part seated on the pipe and a movable valve part actuated by said trigger to seat and unseat said first valve off of said first valve seat for allowing a spraying liquid through said first valve and said first nozzle when said first nozzle is attached to said handle;

wherein when said first nozzle is removed, a rod is connected to said first valve extending along and inside said extension tube, said rod connecting said first valve to a second valve disposed in said extension tube adjacent said second nozzle, said second valve having a second valve seat part;

wherein the first valve seat has a sealing portion protruding into said pipe, and the second valve seat is seated on the distal end of said extension tube with a sealing portion protruding into the extension tube; and wherein upon actuation of the trigger, said first valve and said second valve are simultaneously seated and unseated from said first valve seat and said second valve seat so that said spraying liquid passes through said first valve, flows via said extension tube through the second valve for spraying via said second nozzle.

5. The spray gun according to claim 4 further comprising:

a first clamp nut for attaching said first nozzle to said body, said first clamp nut being removably disposed around said pipe and said first nozzle; and a second clamp nut around said pipe and said extension tube for removably connecting said extension tube to said pipe when said first clamp nut is removed.

6. The spray gun according to claim 5 wherein said second clamp nut removably attaches said extension tube on an end thereof which is proximal to said body when said first clamp nut is removed from said pipe, and said spray gun further comprises a third clamp nut which connects said second nozzle to a distal end of said extension tube.

7. The spray gun according to claim 6 wherein said second and third clamp nuts also assemble said valve seats in cooperative relationship with said first valve and said second valve.

* * * * *